US005129485A

United States Patent [19]

Hoch

[11] Patent Number: 5,129,485

[45] Date of Patent: Jul. 14, 1992

[54] HOME ELEVATOR LOAD CONTROL

[75] Inventor: Frederick M. Hoch, Harrisburg, Pa.

[73] Assignee: Inclinator Company of America, Harrisburg, Pa.

[21] Appl. No.: 605,425

[22] Filed: Oct. 30, 1990

[51] Int. Cl.[5] ..... B66B 11/04

[52] U.S. Cl. ..... 187/20; 187/28; 187/106; 177/147

[58] Field of Search ..... 187/1 R, 1 A, 20, 34, 187/35, 73, 80, 28, 106, 105, 108; 177/147, 132, 245

[56] References Cited

U.S. PATENT DOCUMENTS 2,604,782 7/1952 Rissler et al. ..... 187/1 R
3,610,342 10/1971 Stainken ..... 177/147
4,986,391 1/1991 Salman ..... 187/1 R

*Primary Examiner*—Robert P. Olszewski
*Assistant Examiner*—Kenneth Noland
*Attorney, Agent, or Firm*—Fred Philpitt

[57] ABSTRACT

The invention pertains to a load limiting device for elevating devices that are installed in homes to facilitate the transport of people or goods. The object of this invention is to provide a load limiting device for home elevators which will prevent the operation of the elevator when the load is too great. The device utilizes an improved resilient compressible member which surrounds an elevator lifting cable and is also positioned between a cable anchoring device and a portion of an actuating arm that is coupled to a limit switch.

1 Claim, 1 Drawing Sheet

HOME ELEVATOR LOAD CONTROL

The present invention pertains to a load limiting device for elevating devices that are installed in homes to facilitate the transport of people or goods from one floor to another.

The elevator devices used in homes are sometimes misused by loading the device with more people or goods than the device was designed to handle. This not only causes undue wear and strain on the equipment, but sometimes even results in failure of the equipment. The object of this invention is to provide a load limiting device for home elevators which will prevent the use of the elevator when the load is too great.

Considered from one aspect my invention pertains to a home elevator device that includes a weight supporting framework, a motor and cable means for lifting said weight supporting framework, and guide means for guiding the movement of said weight supporting framework from one elevation to another, the improvement comprising a load limiting device mounted on said weight supporting framework that includes (a) a limit switch that in a first position completes an electrical circuit that allows said motor to be activated so as to control movement of said cable means, and in a second position opens the electrical circuit to said motor so that the motor can no longer move the cable means, (b) an actuating arm having a first portion that is in contact with said limit switch and a second portion that is fixed to or surrounds the end of said cable means so that it will move in concert with the end of said cable means, (c) anchoring means for anchoring the end of said cable means that is furthest from said motor, and (d) a resilient compressible member surrounding said cable means and positioned between said anchoring means and said second portion of the actuating arm so that when the load carried by said weight supporting framework exceeds a certain amount, said resilient compressible member will be compressed between said anchoring means and said second portion of the actuating arm to such an extent that said first portion of said actuating arm will move from said first position to said second position so that said motor can no longer move said cable means.

My invention can be better understood by reference to the attached drawings wherein.

Figure 2:
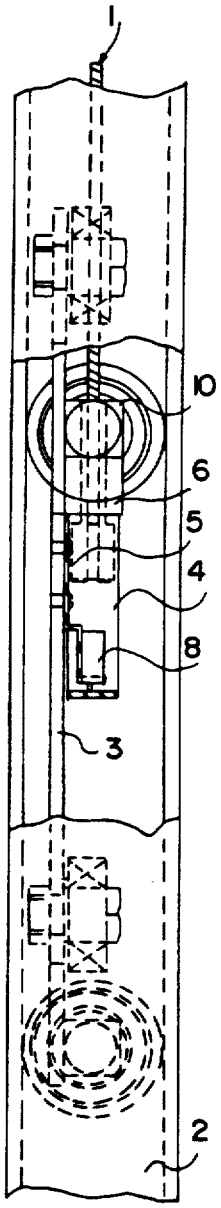
FIG. 2 is a side view, partially in section, of FIG. 1.
Figure 1:
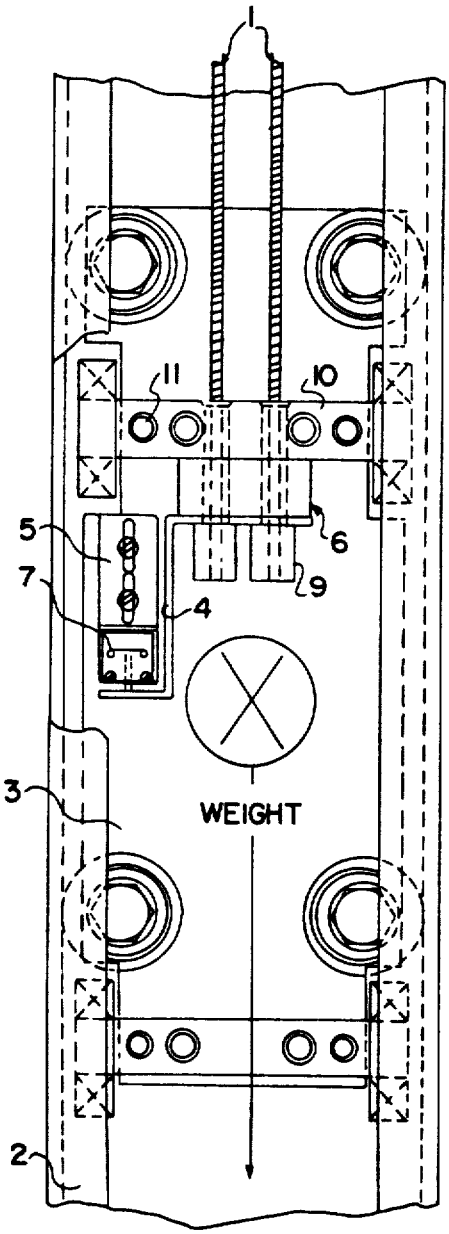
FIG. 1 is a plan view of my device.

FIG. 1 shows cables (1), a weight supporting framework (3) and guide means (2) for guiding the movement of the weight supporting framework (3) from one elevation to another. An electrical motor (not shown) is attached to the cables (1) for exerting an upward lifting force. When a weight (X) (such as a chair or platform or small elevator) is attached to the weight supporting frame-work (3) a downward force is exerted as indicated by the arrow.

The weight supporting framework (3) carries a limit switch (8), an actuating arm (4), an anchoring means (10), and a resilient compressible member (6).

The limit switch (8) in a first position (as shown in FIG. 1) completes an electrical circuit through its electrical contact (7) that allows the motor attached to the cables (1) to be activated so as to control the movement of said cables (1). In a second position (as shown in FIG. 3) the limit switch (8) opens the electrical circuit to the motor so that the motor can no longer exert a force to move the cables (1).

The actuating arm (4) has a first (left) portion that is in contact with one end of the electrical contact (7) of the limit switch (8). The actuating arm (4) also has a second (right) portion that surrounds or is otherwise in a fixed relationship with the ends of the cables (1) so that this second portion will move in concert with these ends of the cables (1). The ends of the cables (1) are shown as being provided with enlarged end pieces (9).

The anchoring means (10) is fixed to the weight supporting framework (3), suitably by bolts (11) or by welding, and the cables (1) pass through openings in anchoring means (10). Although two cables (1) are shown as passing through the anchoring means (10), it will be understood that there could also be only one cable or there could be more than two cables.

Figure 3:
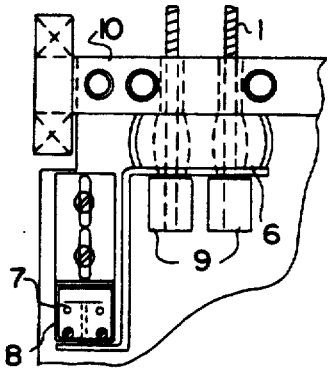
FIG. 3 is a fragmentary view similar to FIG. 1 showing an overload condition of my device.

A resilient compressible member (6) also surrounds the cables (1) and this resilient compressible member (6) is positioned between the anchoring means (10) and the aforesaid second portion of the actuating arm (4) so that when the load carried by the weight supporting framework (3) exceeds a predetermined amount, the resilient compressible member (6) will be compressed as shown in FIG. 3. When the compression of the resilient compressible member (6) between the anchoring means (10) and the second portion of the actuating arm reaches a certain degree of compression and deforms the resilient compressible member, it will cause the first (left) portion of the actuating arm (4) to move as shown in FIG. 3 to disengage the electrical contact (7) so that the motor in turn will no longer be able to move the cables (1). The resilient compressible member can be any suitable elastomer, such as a synthetic resin or a hard rubber.

A limit switch bracket (5) is preferably provided so that the position of the limit switch (8) can be varied. This is a means for varying the load which can be carried before the motor is cut off by the limit switch (8).

I claim:

1. A home elevator device that includes a weight supporting framework, a motor and cable means for lifting said weight supporting framework, and guide means for guiding the movement of said weight supporting framework from one elevation to another, the improvement comprising a load limiting device mounted on said weight supporting framework that includes (a) a limit switch that in a first position completes electrical circuit that allows said motor to be activated so as to control movement of said cable means, and in a second position opens the electrical circuit to said motor so that the motor can no longer move the cable means, (b) an actuating arm having a first portion that is in contact with said limit switch and a second portion that is fixed to or surrounds the end of said cable means so that it will move in concert with the end of said cable means, (c) anchoring means for anchoring the end of said cable means that is furthest from said motor, and (d) a resilient compressible member surrounding said cable means and positioned between said anchoring means and said second portion of the actuating arm so that when the load carried by said weight supporting framework exceeds a certain amount, said resilient compressible member will be compressed between said anchoring means and said second portion of the actuating arm to such an extent that said first portion of said actuating arm will move from said first position to said second position so that said motor can no longer move said cable means.

* * * * *